US008534200B2

(12) United States Patent
Ahuja et al.

(10) Patent No.: US 8,534,200 B2
(45) Date of Patent: Sep. 17, 2013

(54) SUSPENSION APPARATUS AND METHOD

(75) Inventors: Munishwar Ahuja, Bangalore (IN); Mandyam Rangayan Sridhar, Bangalore (IN); Brijesh Raghavan, Bangalore (IN)

(73) Assignee: General Electric Company, Schenectady, NY (US)

( * ) Notice: Subject to any disclaimer, the term of this patent is extended or adjusted under 35 U.S.C. 154(b) by 183 days.

(21) Appl. No.: 13/186,517

(22) Filed: Jul. 20, 2011

(65) Prior Publication Data

US 2013/0019774 A1 Jan. 24, 2013

(51) Int. Cl.
*B61C 1/00* (2006.01)

(52) U.S. Cl.
USPC ..... 105/133

(58) Field of Classification Search
USPC ..... 105/133, 135–139
See application file for complete search history.

(56) References Cited

U.S. PATENT DOCUMENTS

| | | | | |
|---|---|---|---|---|
| 5,119,736 | A | 6/1992 | Chiodi | |
| 2001/0007230 | A1 | 7/2001 | Boivin | |
| 2010/0300324 | A1 * | 12/2010 | Brandstetter et al. | 105/96.1 |

FOREIGN PATENT DOCUMENTS

| | | | |
|---|---|---|---|
| CN | 2586847 | Y | 11/2003 |
| DE | 19844707 | A1 | 6/1999 |
| EP | 0444016 | A2 | 8/1991 |
| EP | 0589866 | A1 | 3/1994 |
| EP | 1065123 | A2 | 3/2001 |
| JP | 20100768808 | A | 4/2010 |
| WO | 2009056415 | A1 | 5/2009 |
| WO | 2010150604 | A1 | 12/2010 |

OTHER PUBLICATIONS

P. Ransome-Wallis.Illustrated Encyclopedia of World Railway Locomotives—Google Books Result.books.google.co.in. Chapter 3, Part I, pp. 143-238.

Pingbo, Ren, Yan and Jing (Traction Power state Key Laboratory, Southwest Jiaotong University, Chengdu, China), Dynamic Performance of Subway Vehicle With Linear Induction Motor System. Journal of Mechanical Systems for Transportation and Logistics. vol. 3 (2010) , No. 1 Special issue on STECH'09 pp. 372-379.

Bogie Page.Railway Technical Web Pages.2010.

* cited by examiner

*Primary Examiner* — Robert J. McCarry, Jr.
(74) *Attorney, Agent, or Firm* — GE Global Patent Operation; John A. Kramer

(57) ABSTRACT

A suspension apparatus that includes a suspension linkage connected between a traction motor and a rail vehicle truck frame at least at first and second locations. The suspension linkage including at the first location a first pin pivotally connecting the traction motor with a cross member of the truck frame, and, at the second location, at least one elastomeric element deformable to fully suspend the traction motor from the truck frame.

21 Claims, 7 Drawing Sheets

SUSPENSION APPARATUS AND METHOD

FIELD OF THE INVENTION

Embodiments of the invention relate to rail vehicles. Other embodiments relate to wheel trucks for rail vehicles and to motor suspensions for rail vehicle wheel trucks.

BACKGROUND OF THE INVENTION

A high-speed train car or locomotive may be supported on two trucks or bogies, each truck or bogie having two or more powered and/or non-powered axles carrying wheels. Each powered axle is driven by a motor through a gear train that includes a pinion gear driven by the traction motor shaft and driving a bull gear mounted on the axle. By way of example, a truck or bogie for use on a diesel-electric rail vehicle includes a frame, an axle mounted on the frame by journal bearings, wheels on the axle, a bull gear on the axle, and a motor and pinion gear attached to the frame. The pinion gear is operably coupled to the bull gear for the traction motor to move the pinion and thereby the bull gear, axle, and wheels. Such a system can result in disadvantageously high forces on the underlying track, due to inertia of "unsprung" mass.

To explain further, mass supported directly on an axle (i.e., not through a vehicle's primary suspension) is known as "unsprung" mass. In operation of high-speed rail systems, the presence of unsprung mass can induce low frequency dynamic forces at the interface of each wheel with the rail. These low-frequency dynamic forces at the wheel-rail interfaces can cause degradation of track geometry.

It is known that track maintenance is the largest expense for operation of a rail corridor. Thus, it is desirable to reduce the unsprung mass of each truck or bogie on a high-speed rail car or locomotive, so as to mitigate the expense of track maintenance.

Unsprung mass may be reduced by supporting the traction motor and/or the gear train of each axle from the truck frame, rather than directly from the axle. For example, leaf springs may be used to support the traction motor with swaying or surging motions relative to the truck frame. However, supporting a motor and/or gearbox from the truck frame (a "suspended motor" configuration) can have the undesirable effect, during operation of the high-speed rail system, of producing relatively large displacements between the traction motor shaft and the axle as compared to conventional trucks or bogies having axle-mounted motors and gearboxes. These large displacements detract from dynamic stability and track-following of the rail vehicle, thereby limiting the achievable speed. The large displacements also increase mechanical stress and wear on power train components, in turn reducing the mean-time-between-failures (MTBF) and maintenance life span for suspended motor configurations, relative to conventional truck frame configurations.

In view of the above, a need exists for relatively simple apparatus that will effectively reduce unsprung mass on a high-speed rail truck, while also mitigating displacements between a motor shaft and a power axle driven from the traction motor shaft.

BRIEF DESCRIPTION OF THE INVENTION

Embodiments of the invention relate to various configurations for suspending a traction motor from a high-speed or other rail vehicle truck frame.

In some embodiments of the invention, the traction motor is suspended by an apparatus that includes a suspension linkage connected between the traction motor and the truck frame at least at first and second locations. The suspension linkage includes at the first location a first pin pivotally connecting the traction motor with the truck frame, and includes at the second location at least one elastomeric element deformable to provide displacement and torsion within limited ranges, such that the traction motor is fully suspended from the truck frame.

In some embodiments of the invention, the traction motor is suspended from the truck frame by an apparatus that includes a pivotal connection of the traction motor to a cross member of the truck frame, and a spring connected between the traction motor and the truck frame. The spring provides displacement and torsion within limited ranges, such that the traction motor is fully suspended from the truck.

In one aspect of the invention, dynamic loading of high-speed or other rail systems is mitigated by fully suspending a traction motor from a rail vehicle truck frame.

In some embodiments of the invention, a suspension apparatus includes a rail vehicle truck frame, which has a cross member, a first side member connected to a first end of the cross member and perpendicular thereto, and a second side member connected to a second end of the cross member and perpendicular thereto. The suspension apparatus also includes a traction motor connected to the cross member of the truck frame by way of a pivot, such that a long axis of the traction motor can move relative to a long axis of the cross member while remaining parallel thereto. The suspension apparatus also includes a biasing assembly operably engaged between the traction motor and the truck frame, and deformable to fully suspend the traction motor about the pivot.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
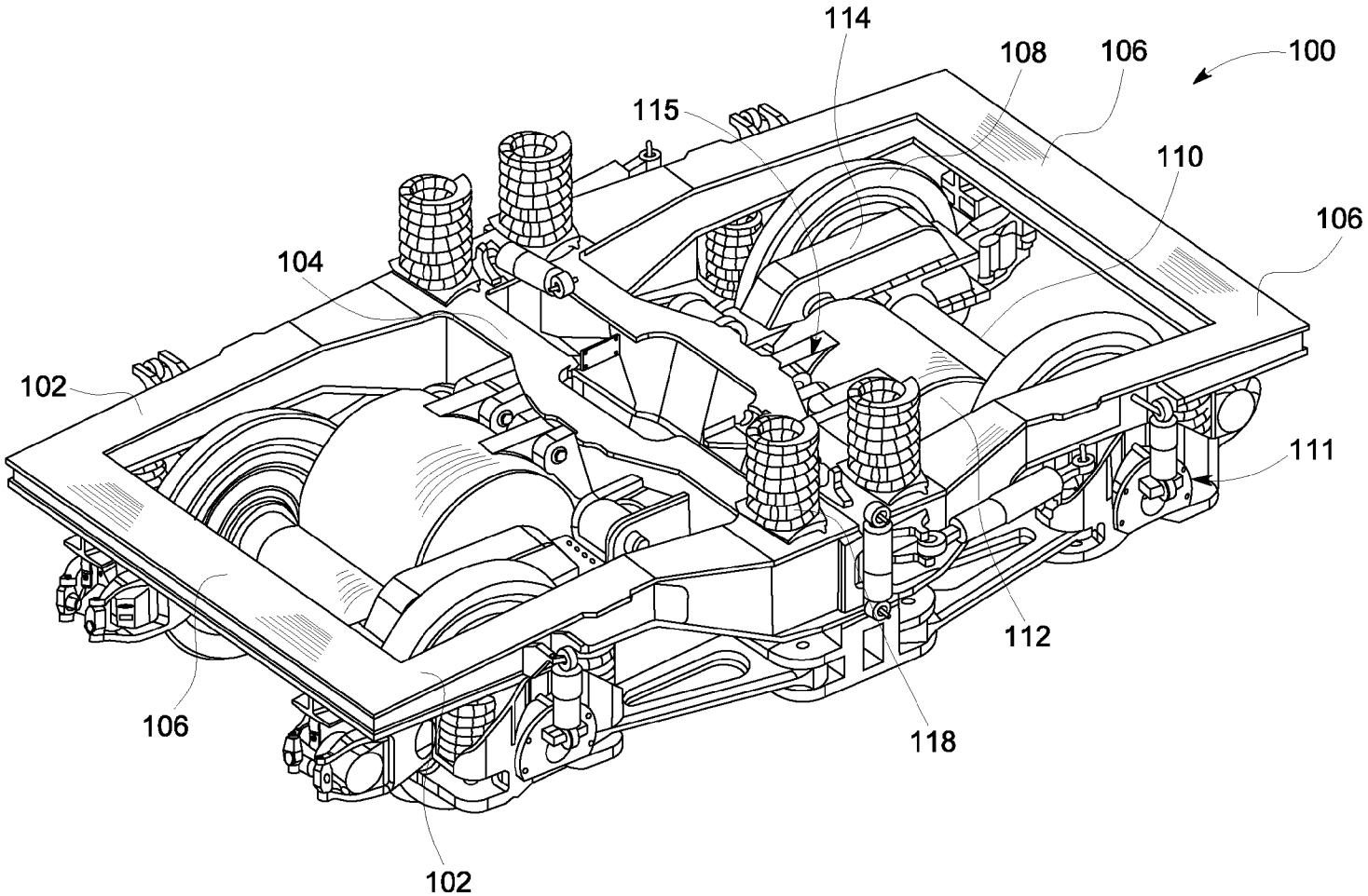
FIG. 1 shows a top perspective view of a rail truck.

Embodiments of the present invention relate to motor suspension assemblies for rail vehicle trucks/bogies, which may be suitable for high-speed rail applications. Reference will be made below in detail to exemplary embodiments of the invention, examples of which are illustrated in the accompanying drawings. Wherever possible, the same reference numerals used throughout the drawings refer to the same or like parts. However, the use of the same reference numerals for the same or like parts does not mean a particular embodiment has to have those parts.

Figure 2:
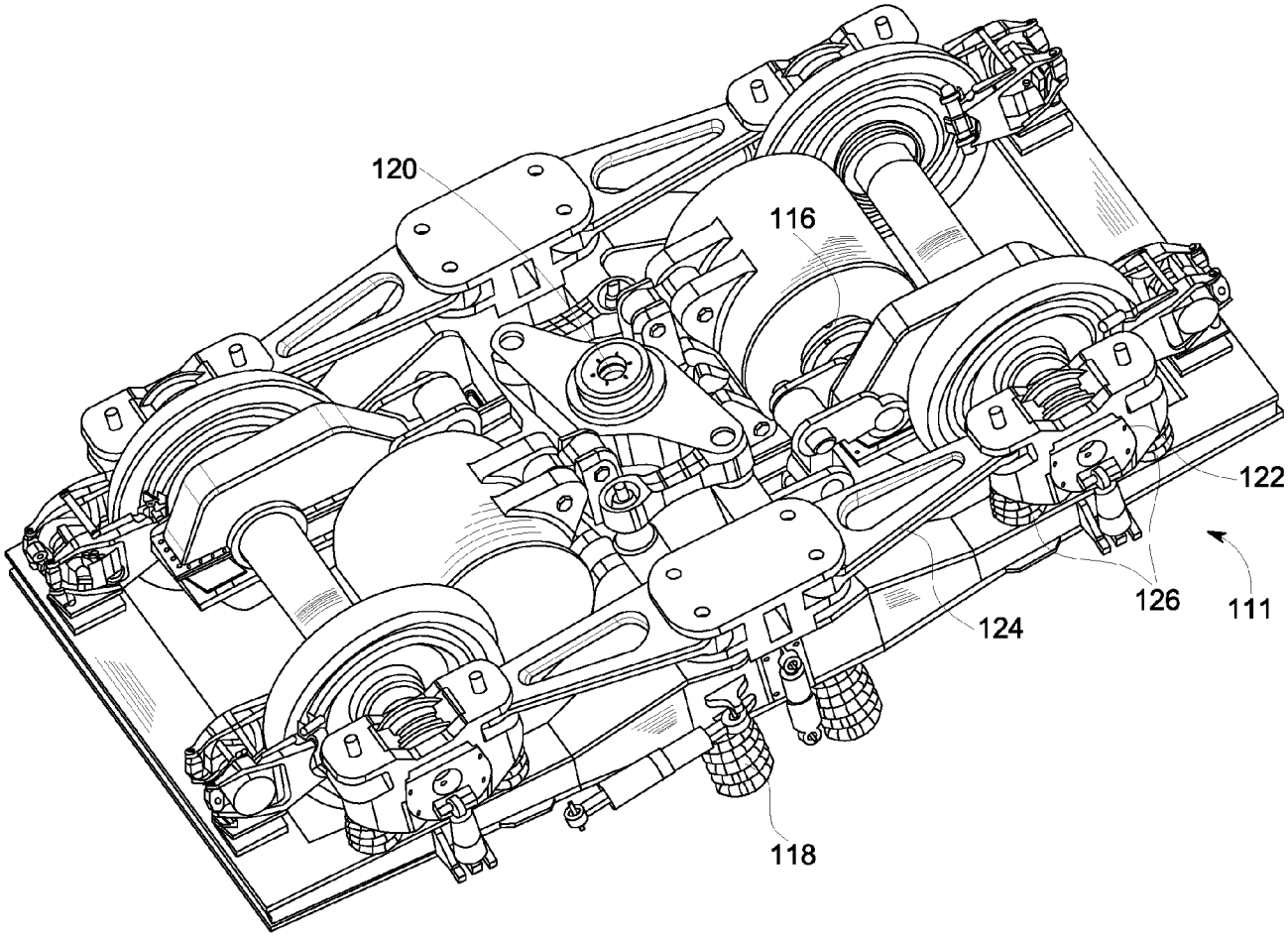
FIG. 2 shows a bottom perspective view of a rail truck with a motor suspended according to a first embodiment of the claimed invention.
Figure 3:
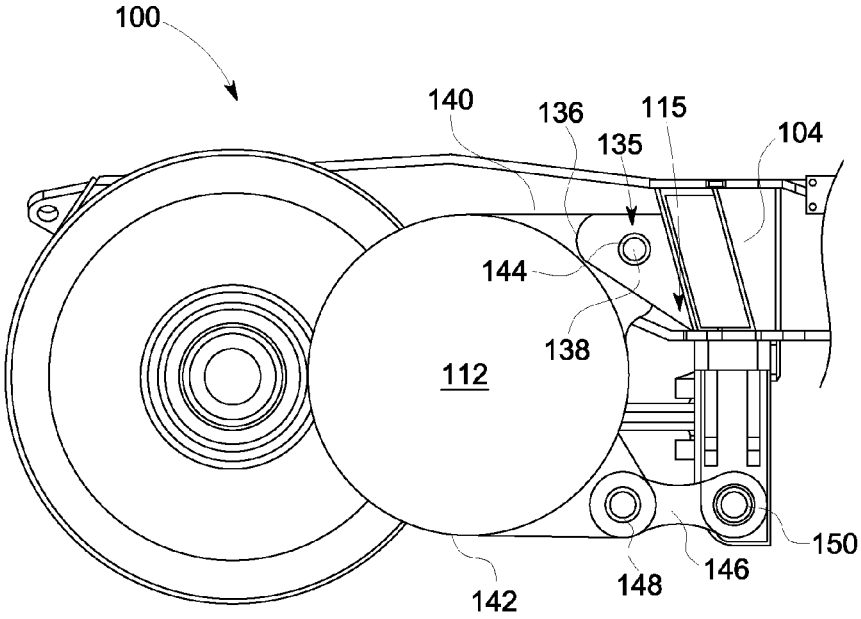
FIG. 3 shows a detail view of the motor suspension according to the first embodiment of the present invention.

Referring to FIGS. 1-3, in a first embodiment of the invention, a rail truck frame 100 (e.g., suitable for use in a high-speed rail vehicle) has two side members 102 that are connected at their midpoints by a transverse beam or cross member 104 (e.g., cross member may be a central cross member) and at their ends by two end members 106 to form a "B" shaped truck configuration. In other embodiments the end members may be omitted to provide an "H" shaped truck. The truck frame is supported by wheels 108 that are carried on at least one power axle 110 that extends orthogonally to, and between, the two side members 102. The power axle is suspended from the side members on axle suspensions 111. Thus, the side members and the cross member are "sprung" mass within the dynamic system of the truck frame 100. The power axle 110 is driven from a traction motor 112 via a gearbox 114. The traction motor 112 is hung from the truck frame by a motor suspension 115. Thus, relative to the wheels 108, the traction motor 112 also is "sprung" mass. The gearbox 114 is supported at least on the power axle 110 and is connected with the traction motor 112 via a coupling 116 that is capable of carrying transverse loading and accommodating angular deflections between the gearbox and the traction motor. The coupling 116 may, for example, be a quill shaft coupling.

In operation, the wheels 108 rest on a track or rail (not shown) disposed beneath the truck, which supports a rail vehicle platform, e.g., frame of a rail car or other unpowered rail vehicle, or a frame of a locomotive or other powered rail vehicle. In the embodiment shown in FIGS. 1-3, the truck includes coil springs 118 for elastically supporting the rail vehicle platform, as well as a traction pin assembly 120 for receiving a traction pin protruding downward from the rail vehicle platform. One of ordinary skill will appreciate that the invention is not limited to any specific method of connecting the truck frame to the rail vehicle platform.

Referring specifically to FIG. 2, each axle suspension 111 includes a hub box or journal box 122 that supports an end of the associated power axle 110. Each hub box 122 is operably connected with the cross member 104 via a wishbone 124, and is operably connected with the side member 102 via a pair of coil springs 126. The wishbone 124 resists deflection of the hub box 122 along or transverse to the side member 102, as well as torsion of the hub box around the wishbone. The coil springs 126 resist deflection of the hub box toward or away from the side member 102, as well as torsion of the hub box orthogonal to the wishbone 124. Thus the truck frame 100 is "fully" sprung or suspended in six axes or degrees of freedom (DOF) relative to each hub box 122.

Referring to FIG. 3, each motor suspension 115 includes an upper pivot 135 that is formed by one or more upper brackets 136 rigidly fastened to the transverse beam 104, a pivot pin 138 that is inserted through the upper brackets, and one or more motor brackets 140 through which the pivot pin also is inserted. The upper pivot 135 can also include one or more elastomeric sleeves or bushings 144 that surround the pivot pin as restoring elements where the pin passes through one or more of the brackets. "Elastomeric" is meant to include any natural or synthetic polymer exhibiting toughness, elastic deformation, and hysteresis in compression and tension, such as, by way of example, EPDM, TPR, latex, silicone rubber, and similar extant or after-developed compounds.

Each motor suspension 115 also includes a lower link 146, which is connected between a first elastomeric bushing 148 mounted on a pivot of the traction motor 112 and a second elastomeric bushing 150 mounted on a pivot of the cross member 104. The lower link is horizontally disposed for absorbing sway, torsion, and lengthwise displacement of the traction motor 112 within limited ranges relative to the truck. In other words, in consideration of the loads exerted by the motor under design conditions of rail vehicle speed and track layout, the lower link 146 acts as a rigid member restricting, for example, pivotal movement of the traction motor 112. The bushings are operably engaged between the lower link 146 and the cross member 104 so as to cushion displacement of the traction motor 112 relative to the pivot 135 and the truck frame 100.

In certain embodiments, elastomeric elements (e.g., elastomeric bushings 148) are characterized as being deformable to provide displacement and torsion within limited ranges, or providing limited torsion and cocking, or the like. In such cases, "limited" means a range of motion as defined by the elastomeric properties of the elastomeric bushing or other element, such as the maximum amount the elastomeric element can deform under force.

The embodiment shown in FIG. 3 provides for full suspension of the traction motor 112 relative to the wheels 108 and relative to the side member 102. This embodiment also is usable on an "H" frame lacking end members 106, as the traction motor 112 is hung only from the cross member 104. Referring back to FIGS. 1 and 2, for each traction motor the upper brackets 136 and the lower bushings 148, 150 are offset from a longitudinal midline of the truck frame 100, such that the cross member 104 can act as a torsion spring between the respective motors.

Figure 4:
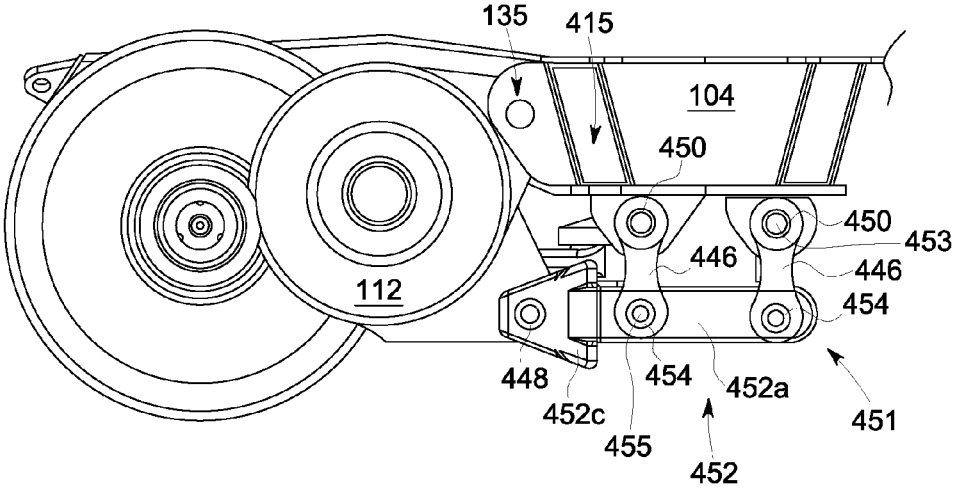
FIG. 4 shows a detail view of a motor suspension, according to a second embodiment of the present invention.

According to a second embodiment of the present invention, as shown in FIG. 4, the traction motor 112 can be hung from the cross member 104 via a suspension 415. The suspension 415 includes an upper pivot 135 that connects the traction motor to the cross member 104, and also includes one or more four bar linkages 451 that connect the traction motor to the cross member. Each of the four bar linkages 451 includes links 446 that are pivotally connected at first ends to elastomeric bushings 450 mounted on pins 453 protruding from the cross member, and at second ends by pins 455 to elastomeric bushings 454 mounted in a heavy link 452, which in this embodiment is the long movable bar of the parallelogram linkage. The pins 453 and 455 collectively provide a set of second pins in addition to the pin within the upper pivot 135. As shown, the heavy link 452 may include left and right legs 452*a*, 452*b* as well as a head bracket 452*c* for receiving the elastomeric bushing 448.

Figure 9:
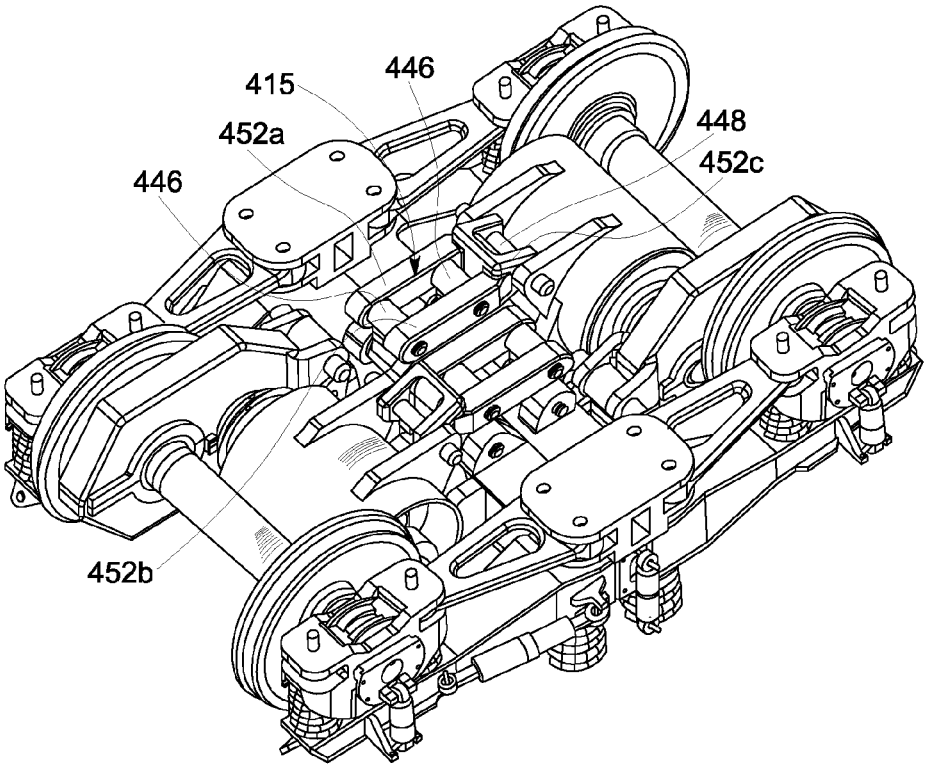
FIG. 9 shows in perspective view the traction motor suspension shown in FIG. 4.

The heavy link is pivotally connected, at an end distal from the cross member 104, to another elastomeric bushing 448 that is mounted on a lower pivot of the traction motor. The links 446 are vertically disposed so that the various bushings act as restoring elements for absorbing sway, torsion, cocking, and vertical displacement of the traction motor within limited ranges relative to the truck. Again, this second embodiment is usable either on an "H" frame or on a "B" frame. FIG. 9 shows that, in one embodiment, the links 446 in the four bar linkage 451 are arranged such that the bushings 448, 450, 454 together can act as a biasing assembly for restraining oscillation of the traction motor 112 about a vertical axis through the cross member 104.

Figure 5:
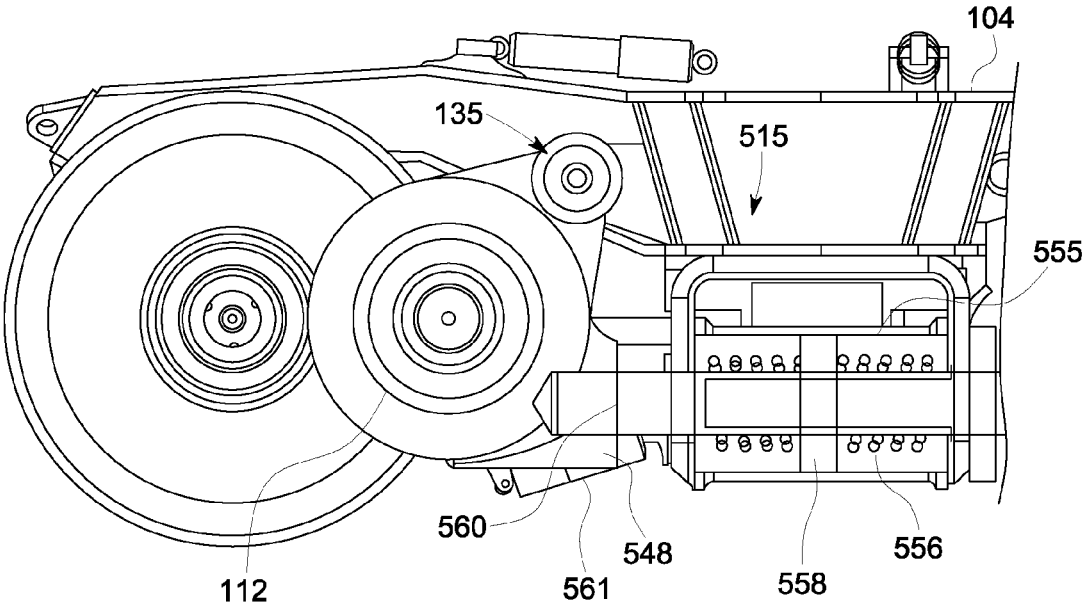
FIG. 5 shows a detail view of a motor suspension, according to a third embodiment of the present invention.
Figure 10:
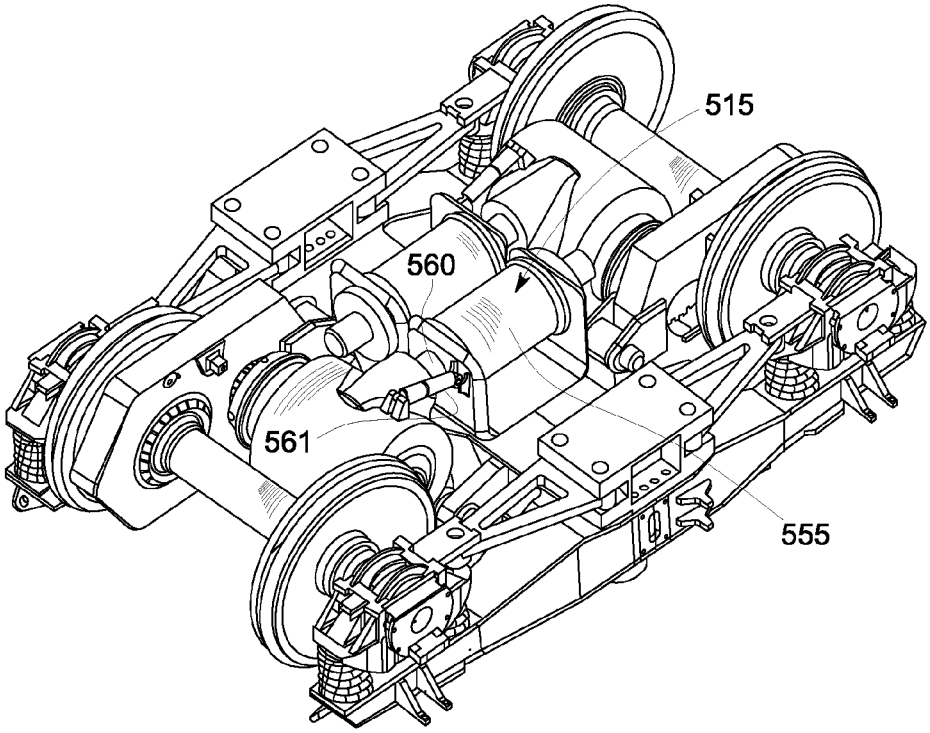
FIG. 10 shows in perspective view the traction motor suspension shown in FIG. 5.

Referring to FIG. 5, in a suspension apparatus 515 according to a third embodiment of the present invention, the traction motor 112 is hung from the cross member 104 via an upper pivot 135. The traction motor 112 also is connected to the cross member via a coil spring piston assembly 555 that is mounted under the cross member. The coil spring piston assembly houses a spring 556 that engages a piston disc 558 mounted on a hollow shaft 560. The hollow shaft is rigidly connected with a lower bracket 548 mounted to the traction motor 112. Thus, the spring 556 may act together with the hollow shaft and the lower bracket as a biasing assembly to absorb and resist displacement of the traction motor about the upper pivot 135. Adjacent to the lower bracket, an air spring 561 provides additional resistance to swaying motions of the traction motor. Referring to FIG. 10, the piston assembly 555 for each of the traction motors 112 is horizontally offset from the other across a longitudinal midline of the truck frame 100.

Figure 6:
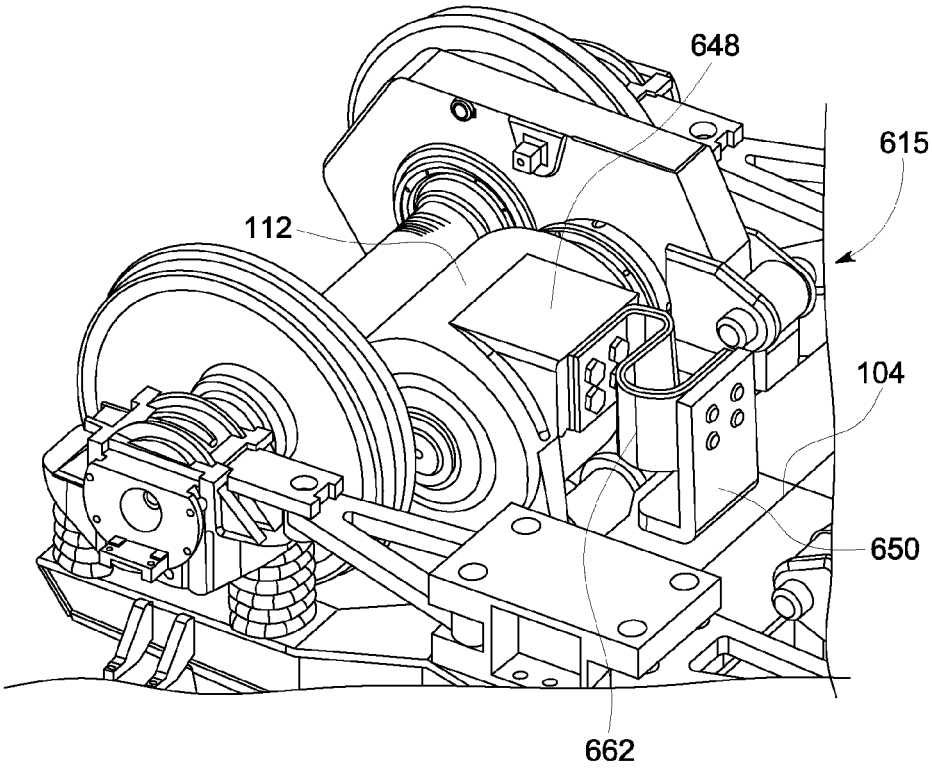
FIG. 6 shows a detail view of a motor suspension, according to a fourth embodiment of the present invention.
Figure 11:
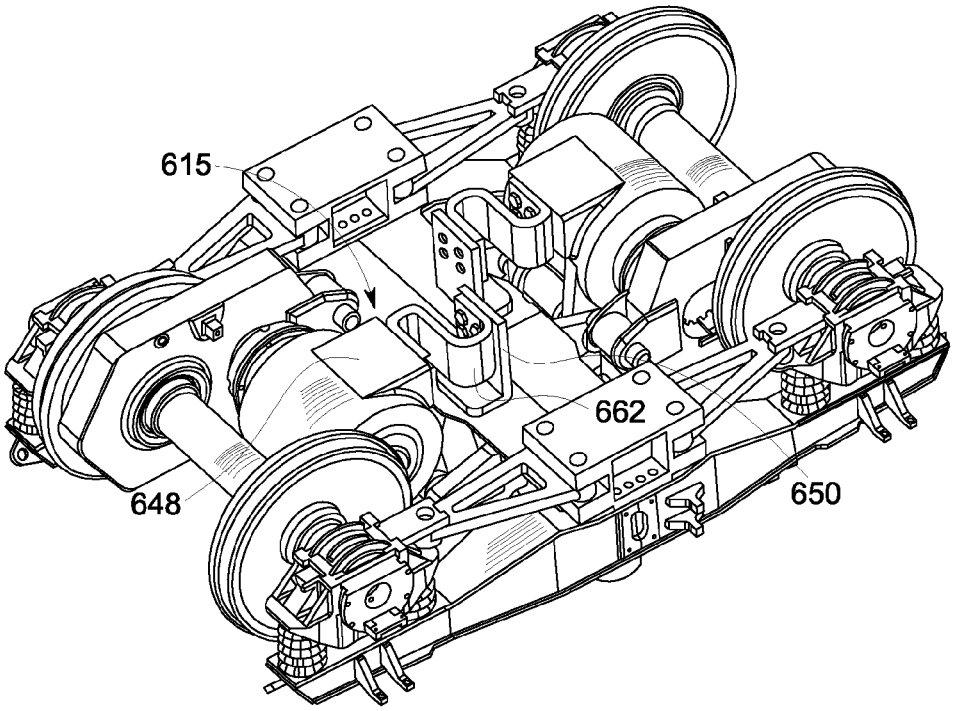
FIG. 11 shows in perspective view the traction motor suspension shown in FIG. 6.

In a suspension apparatus 615 according to a fourth embodiment of the invention, as shown in FIG. 6, the traction motor 112 is hung from the cross member 104 by an upper pivot 135 and also is sprung from the cross member 104 via an S-spring 662 (further discussed below with reference to FIG. 8). The S-spring is mounted to the traction motor via a bracket 648 and is mounted to the cross member via a bracket 650. The S-spring strongly resists vertical displacement of the traction motor, and provides for limited displacement of the traction motor along the truck as well as torsion and sway of the traction motor around the upper pivot. As shown in FIG. 11, the S-spring 662 corresponding to each of two motors 112 is horizontally offset from the other S-spring.

Figure 7:
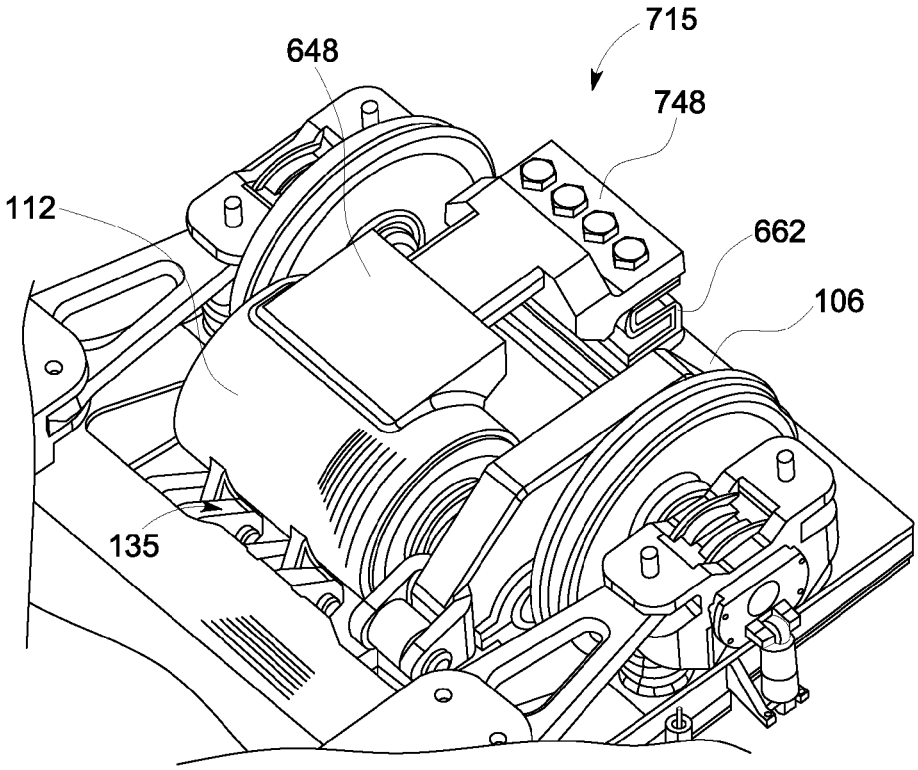
FIG. 7 shows a detail view of a motor suspension, according to a fifth embodiment of the present invention.
Figure 12:
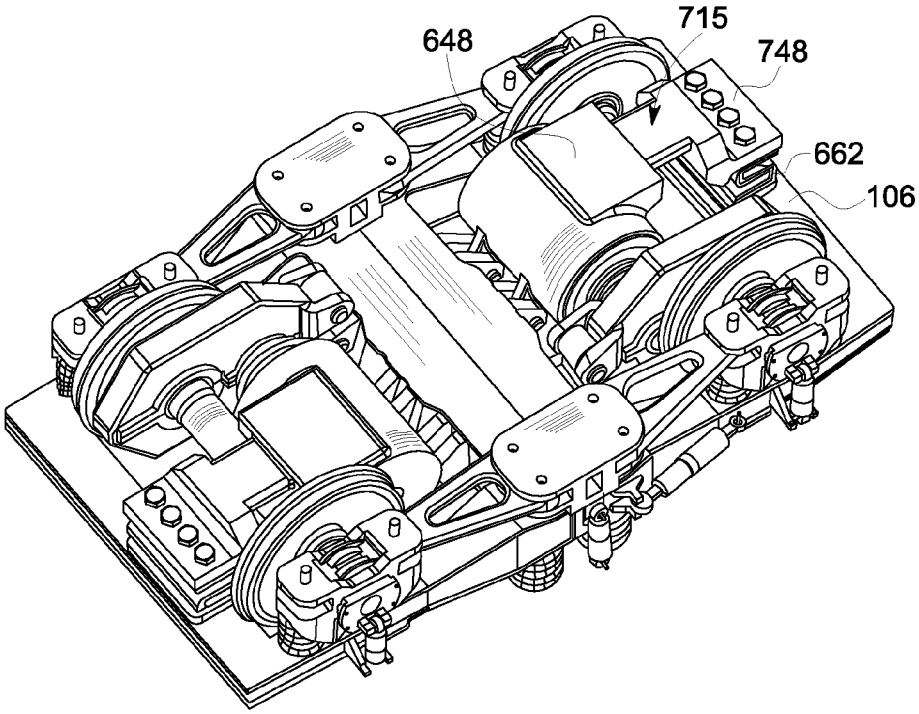
FIG. 12 shows in perspective view the traction motor suspension shown in FIG. 7.

FIG. 7 shows a suspension apparatus 715 according to a fifth embodiment of the invention, wherein the traction motor is hung from the cross member 104 via an upper pivot 135 and also is hung from one of the end members 106 via an S-spring 662. In this embodiment, the S-spring is mounted directly to the end member and is mounted to the traction motor via a bracket 648 and a beam 748. FIG. 12 shows that the traction motors 112 may be horizontally offset from each other across the truck frame 100.

Figure 8:
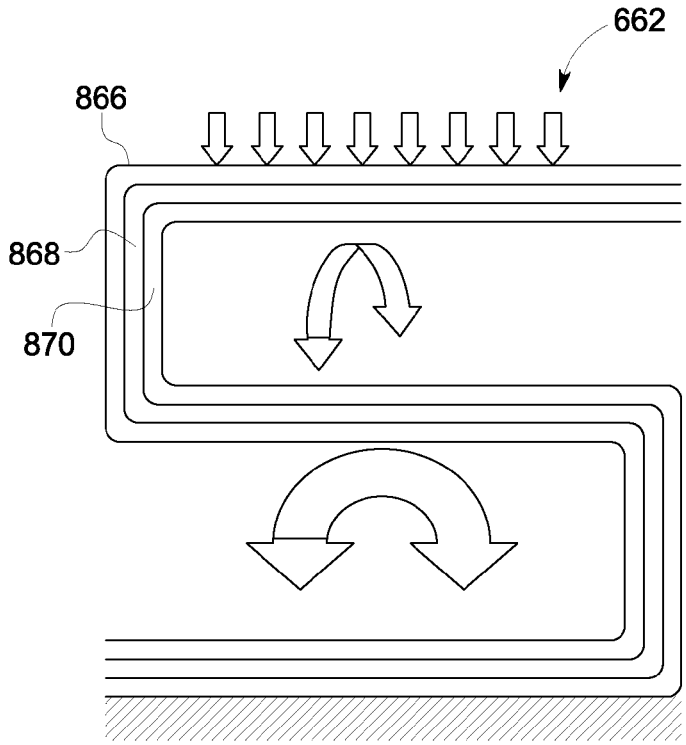
FIG. 8 shows a side view of an S-spring usable in either embodiment shown in FIG. 6 or FIG. 7.

Referring to FIG. 8, an S-spring 662 includes laminated and interbonded layers of elastomer 866, metal 868, and bondant resin 870. In some embodiments the elastomer layers 866 include silicone rubber, for example, room temperature vulcanized (RTV) silicone. In other embodiments the elastomer layers include latex. In some embodiments the metal layers 868 include steel, for example, mild sheet steel. In some embodiments the bondant resin layers 870 include epoxy (polyepoxide). In some embodiments the layers 866, 868, 870 can be laminated together as a flat structure, then bent to form the S-spring 662; in other embodiments, the metal layers 868 are bent together, separated, and then laminated with the relatively flexible elastomer layers 866 and the bondant resin layers 870. Arrows in FIG. 8 indicate three degrees of freedom provided by the S-spring 662: axial deflection in tension and compression, and bending in two orthogonal vertical planes. In some embodiments, mechanical interaction of the S-spring layers provides hysteresis damping or cushioning of cyclic displacements and shock loads. As discussed above, the S-spring may be used as part of a biasing assembly in embodiments of the inventive suspension apparatus.

In use, a suspension apparatus according to an embodiment of the present invention includes a suspension linkage connected between a traction motor and a rail vehicle truck frame at least at first and second locations. The suspension linkage includes at the first location a first pin pivotally connecting the traction motor with a cross member of the truck frame, and includes at the second location at least one elastomeric element deformable to provide displacement and torsion within limited ranges, such that the traction motor is fully suspended from the truck frame. The suspension apparatus may include at least one link connected between a first elastomeric bushing on the traction motor and a second elastomeric bushing on the truck frame. The at least one link may be pivoted within a plane extending transverse to the first pin. The suspension apparatus may include a four bar linkage connected between the traction motor and the truck frame. The four bar linkage may be pivotally connected to the truck frame for movement within a plane extending transverse to the first pin. The four bar linkage may be a parallelogram linkage. The traction motor may be pivotally connected to a heavy link of the parallelogram linkage. The four bar linkage may include at least one second pin mounted in an elastomeric bushing providing limited torsion and cocking of the four bar linkage transverse the first pin. Each second pin of the four bar linkage may be mounted in an elastomeric bushing.

In another embodiment of the invention, a suspension apparatus includes a pivotal connection of a traction motor to a cross member of a truck frame, and a spring connected between the traction motor and the truck frame. The spring may provide displacement and torsion within limited ranges, such that the traction motor may be fully suspended from the truck. The spring may be an S-spring connected between the traction motor and the truck. The truck further may include an end member extending between and orthogonal to the side members distal from the cross member, with one end of the S-spring connected to the traction motor, and the other end of the S-spring connected to the end member. Alternatively, the S-spring may be connected between the traction motor and a cross member of the truck. The S-spring may be connected along a direction transverse to the pivotal connection of the traction motor to the truck.

In another embodiment of the invention, the spring connected between the traction motor and the truck may be a coil spring operably connected between the traction motor and a cross member of the truck along a spring axis transverse to the pivotal connection. The coil spring may be supported on a piston rigidly connected to the traction motor and slidingly connected to the cross member.

In one aspect of the invention, dynamic loading of high-speed rail systems may be mitigated by fully suspending a traction motor of a high-speed rail vehicle truck from the high-speed rail vehicle truck. Fully suspending the traction motor may include pivotally connecting the traction motor to the high-speed rail vehicle truck via a pin, and pivotally connecting the traction motor to the high-speed rail vehicle truck via a pendulum linkage including an elastomeric element.

In another embodiment of the invention, a suspension apparatus includes a rail vehicle truck frame, which has a cross member, a first side member connected to a first end of the cross member and perpendicular thereto, and a second side member connected to a second end of the cross member and perpendicular thereto. The suspension apparatus also includes a traction motor connected to the cross member of the truck frame by way of a pivot, such that a long axis of the traction motor can move relative to a long axis of the cross member while remaining parallel thereto. The suspension apparatus also includes a biasing assembly operably engaged between the traction motor and the truck frame, and deformable to fully suspend the traction motor about the pivot.

As noted, embodiments of the invention are applicable for use in high-speed rail vehicles. In one aspect, high-speed means configured for traveling at sustained speeds of at least 177 km/hr (based on U.S. Federal Railroad Administration standards). In another aspect, high-speed means configured for traveling at sustained speeds of at least 200 km/hr (based on European Union standards; also generally comports with the U.S. Department of Transportation's guidelines).

One of ordinary skill in the art will understand that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person of ordinary skill in the art to practice the embodiments of invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made to the above-described embodiments of the inventive motor suspension apparatus and method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A suspension apparatus comprising:

a suspension linkage connected between a traction motor and a cross member of a rail vehicle truck frame at least at first and second locations, wherein the suspension linkage includes at the first location a first pin pivotally connecting the traction motor with the cross member of the truck frame, and includes at the second location at least one elastomeric element deformable to provide displacement and torsion within limited ranges, such that the traction motor is fully suspended from the cross member of the truck frame.

2. An apparatus as claimed in claim 1, further comprising at least one link connected between a first elastomeric bushing on the traction motor and a second elastomeric bushing on the cross member of the truck frame.

3. An apparatus as claimed in claim 2, wherein the at least one link is pivoted within a plane extending transverse to the first pin.

4. An apparatus as claimed in claim 1, further comprising a four bar linkage connected between the traction motor and the cross member of the truck frame.

5. An apparatus as claimed in claim 4, wherein the four bar linkage includes at least one elastomeric bushing.

6. An apparatus as claimed in claim 5, wherein the four bar linkage is pivotally connected to the cross member of the truck frame for movement within a plane extending transverse to the first pin.

7. An apparatus as claimed in claim 4, wherein the four bar linkage is a parallelogram linkage.

8. An apparatus as claimed in claim 7, wherein the traction motor is pivotally connected to a heavy link of the parallelogram linkage.

9. An apparatus as claimed in claim 4, wherein the four bar linkage includes at least one second pin mounted in an elastomeric bushing providing limited torsion and cocking of the four bar linkage transverse the first pin.

10. An apparatus as claimed in claim 9, wherein each second pin of the four bar linkage is mounted in a respective elastomeric bushing.

11. A suspension apparatus comprising:

a pivotal connection of a traction motor to a cross member of a truck frame; and a spring connected between the traction motor and the cross member truck frame, the spring providing displacement and torsion within limited ranges, such that the traction motor is fully suspended from only the cross member of the truck frame.

12. An apparatus as claimed in claim 11, wherein the spring is an S-spring connected between the traction motor and the cross member of the truck frame.

13. An apparatus as claimed in claim 12, wherein the truck frame comprises the cross member, side members connected to the cross member, and an end member extending between and orthogonal to the side members distal from the cross member, with a first end of the S-spring connected to the traction motor, and a second end of the S-spring connected to the end member.

14. An apparatus as claimed in claim 13, wherein the S-spring is connected along a direction transverse to the pivotal connection of the traction motor to the cross member of the truck frame.

15. An apparatus as claimed in claim 12, wherein the S-spring is connected between the traction motor and the cross member.

16. An apparatus as claimed in claim 15, wherein the S-spring is connected along a direction transverse to the pivotal connection of the traction motor to the cross member.

17. An apparatus as claimed in claim 11, wherein the spring is a coil spring operably connected between the traction motor and the cross member along a spring axis transverse to the pivotal connection.

18. An apparatus as claimed in claim 17, wherein the coil spring is supported on a piston rigidly connected to the traction motor and slidingly connected to the cross member.

19. A method for mitigating dynamic loading of high-speed rail systems, comprising:

fully suspending a traction motor from only a transverse member of a high-speed rail vehicle truck frame such that the traction motor is not suspended from a head beam.

20. A method as claimed in claim 19, wherein fully suspending a traction motor includes pivotally connecting the traction motor to the high-speed rail vehicle truck frame via a pin, and pivotally connecting the traction motor to the high-speed rail vehicle truck frame via a pendulum linkage including an elastomeric element.

21. A suspension apparatus comprising:

a rail vehicle truck frame comprising a cross member, a first side member connected to a first end of the cross member and perpendicular thereto, and a second side member connected to a second end of the cross member and perpendicular thereto;

a traction motor connected to the cross member by way of a pivot, such that a long axis of the traction motor can move relative to a long axis of the cross member while remaining parallel thereto; and a biasing assembly operably engaged between the traction motor and the cross member of the truck frame, and deformable to fully suspend the traction motor about the pivot such that the traction motor is suspended solely from the cross member.

* * * * *